United States Patent [19]

Ahrens

[11] Patent Number: 4,893,807

[45] **Date of Patent: * Jan. 16, 1990**

[54] PLAYGROUND SLIDE

[75] Inventor: Paul W. Ahrens, Monett, Mo.

[73] Assignee: Miracle Recreation Equipment Company, Monett, Mo.

[ * ] Notice: The portion of the term of this patent subsequent to Mar. 14, 2006 has been disclaimed.

[21] Appl. No.: 273,948

[22] Filed: Nov. 21, 1988

Related U.S. Application Data

[63] Continuation-in-part of Ser. No. 55,431, May 28, 1987, Pat. No. 4,811,943.

[51] Int. Cl.[4] ..... A63G 21/02

[52] U.S. Cl. ..... 272/56.5 R; 104/69

[58] Field of Search ..... 272/56.5 R, 56.5 SS; 182/48, 49; D21/244; 104/69, 70; 193/12

[56] References Cited

U.S. PATENT DOCUMENTS

| | | | |
|---|---|---|---|
| 506,238 | 10/1893 | Kirker | 182/49 |
| 803,119 | 10/1905 | Logan | 272/56.5 R |
| 3,083,015 | 3/1963 | Barenholtz et al. | 182/49 X |
| 3,556,522 | 1/1971 | Gale | 272/56.5 R |
| 4,149,710 | 4/1979 | Rouchard | 272/56.5 R |
| 4,211,400 | 7/1980 | Ray | 272/56.5 R |
| 4,299,171 | 11/1981 | Larson | 104/70 |
| 4,379,551 | 4/1983 | Ahrens | 272/56.5 R |
| 4,394,173 | 7/1983 | Aste | 272/56.5 R |

*Primary Examiner*—Richard E. Chilcot, Jr.
*Attorney, Agent, or Firm*—Zarley, McKee, Thomte, Voorhees & Sease

[57] ABSTRACT

A spiral slide includes interconnected bedway sections each of which are hollow and include as an integral part of the section body a sleeve telescopically engaging a ground-support post. Fasteners interconnect the end-to-end bedway sections and are disposed on the interior of these sections and are accessible through capped openings. Fasteners may be formed as an integral part of the end wall. A fastener recess may be formed on the bottom side of the bedway section by the bottom wall converging upwardly towards the top wall to form a connecting flange with the fastener recess being between the flange and the bottom wall.

8 Claims, 4 Drawing Sheets

PLAYGROUND SLIDE

This application is a continuation-in-part of application Ser. No. 55,431, filed May 28, 1987 now U.S. Pat. No. 4,811,943.

BACKGROUND INVENTION

The typical playground slide has a number of shortcomings. Exposed fasteners connecting bedway sections are dangerous to the users and are tempting to vandals to disassemble the slides. Most slides require a metal bedding for a smooth sliding surface. This substantially increases the cost of the slide. Conventional slides include many component parts which require considerable time to assemble and require large inventories of parts to accommodate desired slide configurations as required by various playground designs.

What is needed is a slide comprising a minimum of parts which can be assembled in any desired configuration and one which utilizes bedway sections which are free of any hardware which can injure the users or be tempting to vandals to disassemble. Ideally, the bed surface of the midway should not require metal plating to provide a smooth slide surface. The connection between the midway section and the support post should be free of any cracks that could catch a user's hands or clothing and cause injury.

SUMMARY OF THE INVENTION

The spiral slide of this invention includes four basic bedway sections which may be arranged in any desired configuration. Each section is hollow in construction and bolts which interconnect the bedway sections have their ends inside the hollow interior of the sections. Access openings are provided in an adjacent sidewall and are capped to provide a smooth exterior finish, and thus, the hardware is totally hidden.

A sleeve for mounting the bed section on the ground-support post is an integral part of the sidewall and thus has no crack between it and the bedway section to catch clothing or fingers. The material used in the bedway section is polyethylene which is smooth and requires no additional metal plating to provide a satisfactory sliding surface.

Alternate fastening arrangements are contemplated which involve forming a fastener in the end walls such that only one removable bolt fastener is required which will extend through the end wall of the other bedway section or through the flange on a platform being connected to the bedway section. A further alternative is to provide a fastener recess on the bottom side of the bedway section which exposes the fastener from the bottom side only and partially conceals it in the recess. The recess is formed by extending the bottom wall of the bed upwardly toward the top wall where the two walls merge to form a downwardly extending connecting flange which provides a fastener recess between the connecting flange and the bottom wall.

The bedwall sections are roto molded, and thus, the entire body including the integral sleeve is the result of one continuous wall construction forming a common hollow interior.

DESCRIPTION OF THE PREFERRED EMBODIMENT

Figure 1:
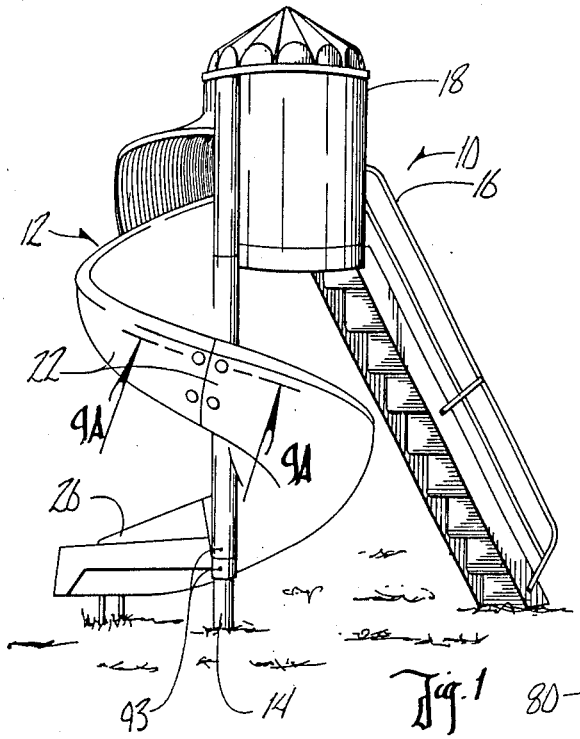
FIG. 1 is a side elevational view of a spiral slide utilizing bedway sections of this invention.

The spiral slide of this invention is referred to generally in FIG. 1 by the reference numeral 10 and includes a bedway 12 extending around and supported by a ground post 14. A stairs 16 leads to a covered platform 18.

Figure 3A:
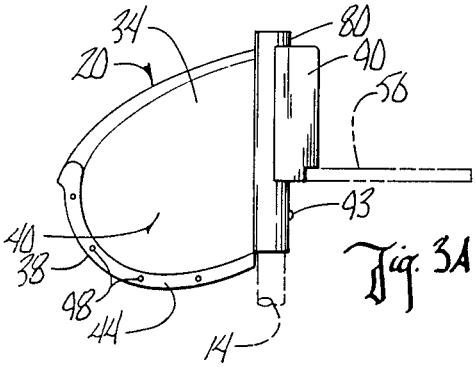
FIGS. 3A and 3B are fragmentary side elevational and top plan views respectively of the top entry one quarter bedway section.
Figure 3B:
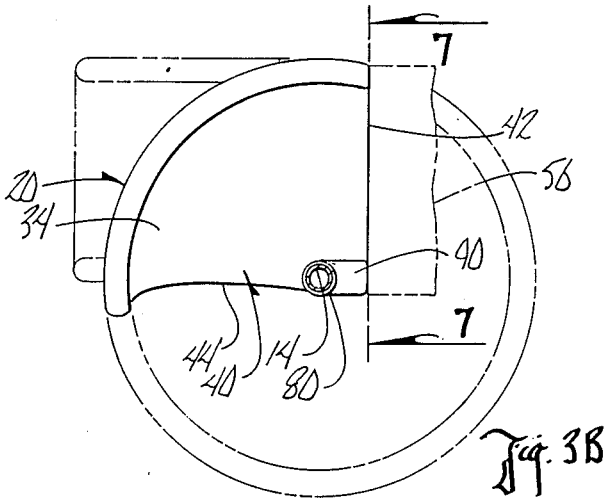
Figure 4A:
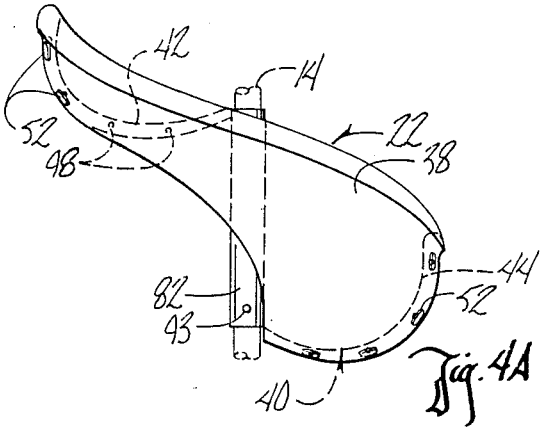
FIGS. 4A and 4B are side elevational and top plan views respectively of the one-half turn bedway section.
Figure 4B:
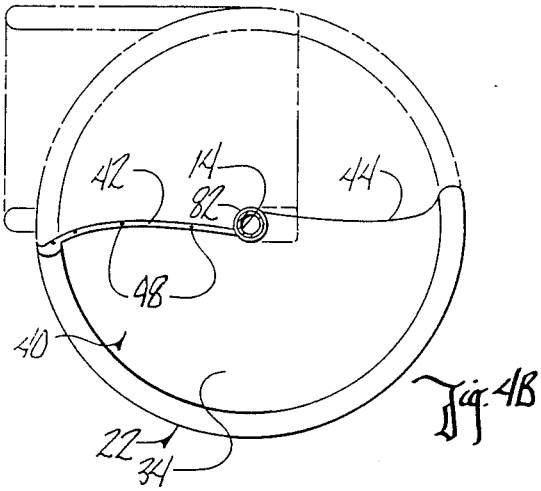
Figure 5A:
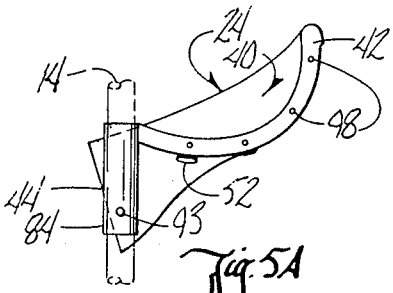
FIGS. 5A and 5B are side elevational and top plan views respectively of a one-fourth turn bedway section.
Figure 5B:
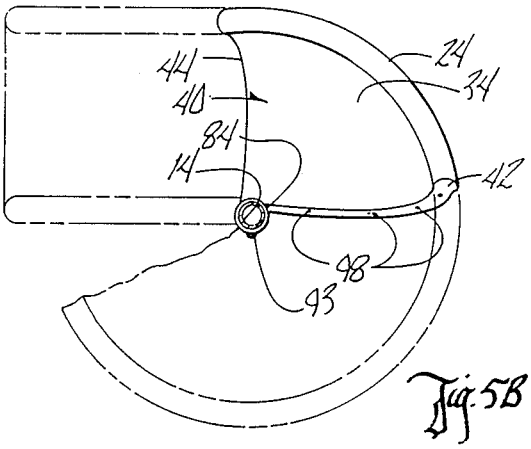
Figure 6A:
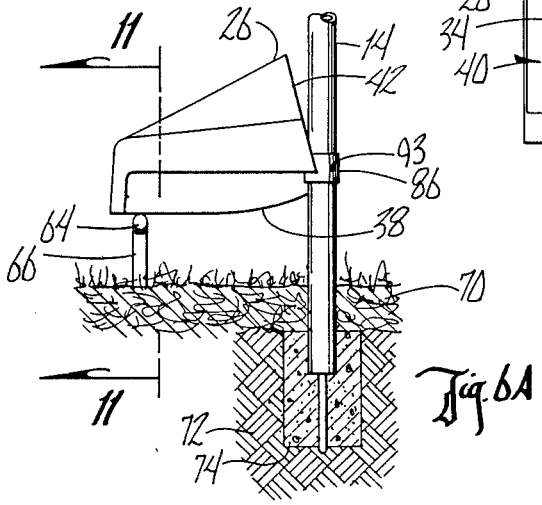
FIGS. 6A, and 6B are side elevational and top plan views respectively of the bottom exit bedway section.

The bedway 12 may be constructed in any desired configuration utilizing a combination of four bedway sections as illustrated in FIGS. 3A and 3B through FIGS. 6A and 6B. A top entry one-quarter section 20 is seen in FIG. 3A, while a one-half turn bedway section 22 is illustrated in FIG. 4A and a one-quarter turn bedway section 24 is seen in FIG. 5A. A bottom exit bedway section 26 is shown in FIG. 6A.

Figure 2:
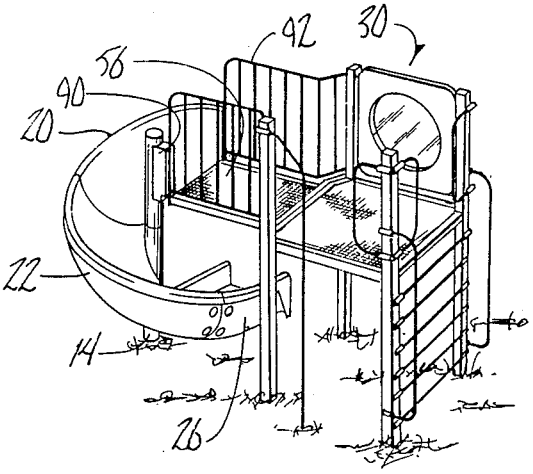
FIG. 2 is a perspective view of an alternate slide
Figure 8:
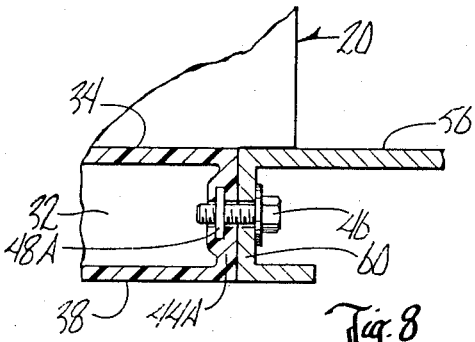
FIG. 8 is a cross-sectional view taken along line 8—8 in FIG. 7.
Figure 7:
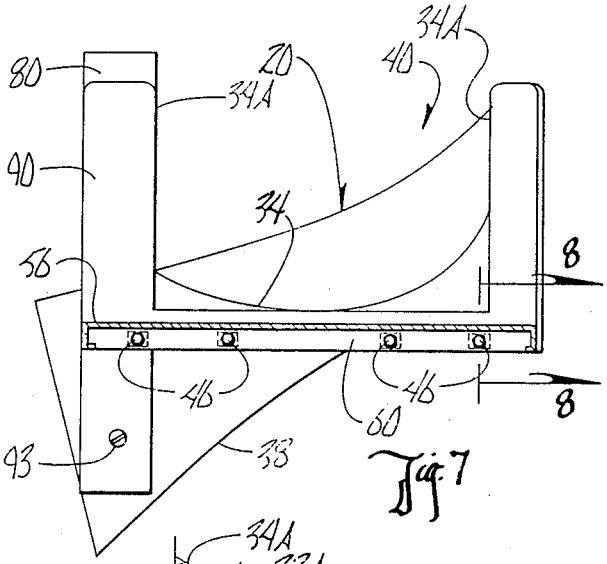
FIG. 7 is a cross-sectional view taken along line 7—7 in FIG. 3B showing the connection of the entry top section to a platform.

The slide 10 in FIG. 1 utilizes a one-half turn section 22 at the top connected to a platform (not shown) under the covered platform 18. A second half-turn bedway section 22 is connected to a bottom exit bedway section 26. In FIG. 2, an alternate arrangement is shown wherein a playground 30 includes a top one-quarter entry section 20 connected to a one-half turn section 22 in turn connected to a bottom exit section 26.

Figure 11:
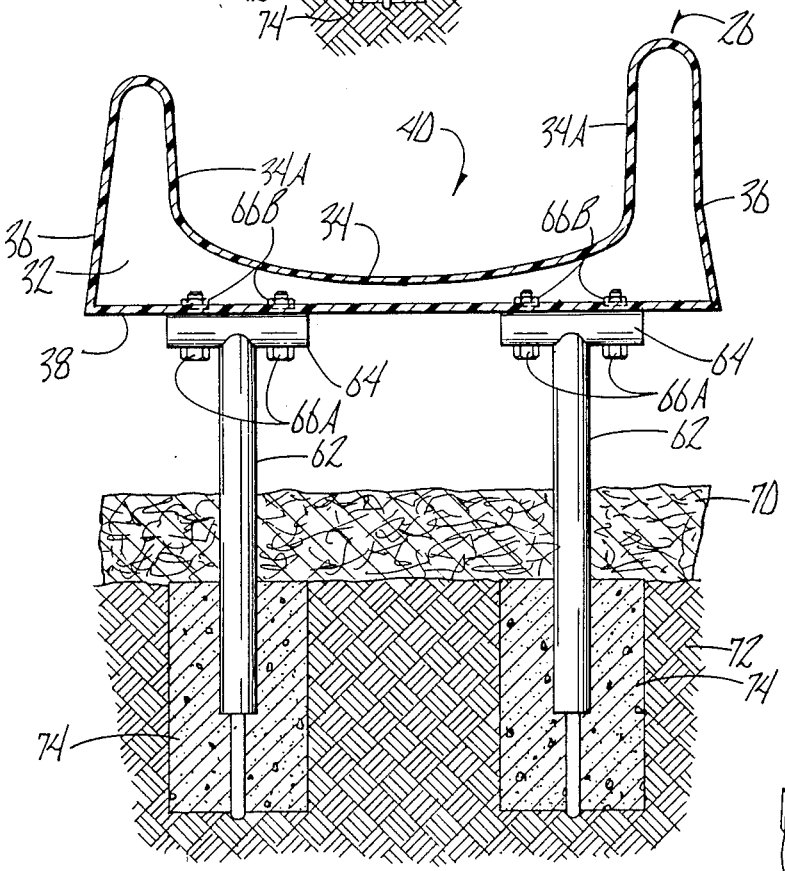
FIG. 11 is a cross-sectional view taken along line 11—11 in FIG. 6A showing the connection of the exit bedway to ground-supporting posts.
Figure 12:
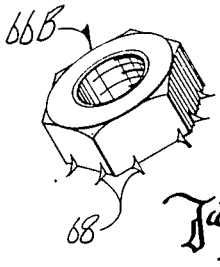
FIG. 12 is a perspective view of the bolts formed integrally in the bottom wall of the exit bedway.
Figure 10:
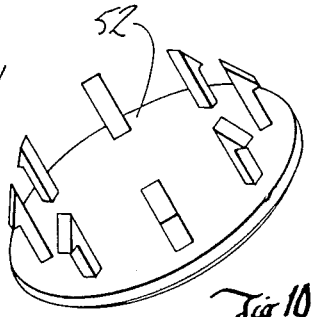
FIG. 10 is a perspective view of a cap for closing the access opening.

Each of the bedway sections are constructed using the same roto molding process which provides a hollow body having a hollow interior 32, as seen in FIG. 11, defined by a top wall 34 which functions as the sliding surface, opposite sidewalls 36, and a bottom wall 38. The top wall 34 includes opposite side portions 34A which define a trough 40 for the bedway.

Figure 9A:
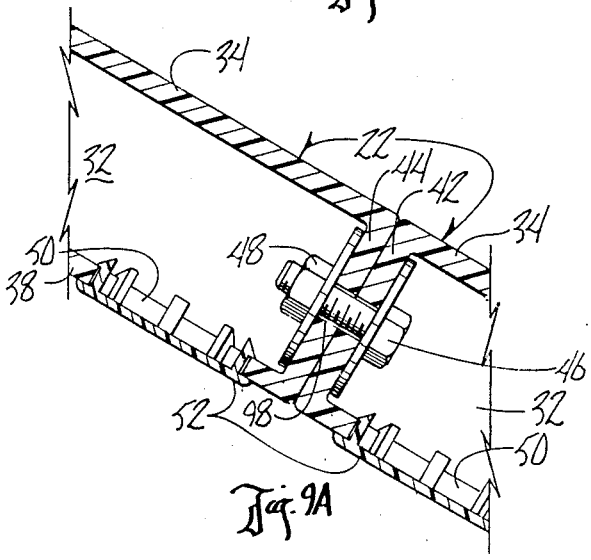
FIG. 9A is a cross-sectional view taken along line 9—9 in FIG. 1 showing the fastener connection between interconnected bedway sections.

The connections between end-to-end bedway sections 22 is seen in FIG. 9A. Each of the sections have upper and lower end walls 42 and 44, respectively, which are in abutting end-to-end engagement and are interconnected by a bolt 46 and a nut 48. An access opening 50 is provided in the adjacent bottom side wall 38 and is closed by a cap 52. The bolt fasteners 46 and 48 may be reached through the openings 50 for assembly and disassembly. The fasteners are totally hidden upon the access opening 50 being closed by the caps 52.

Figure 9B:
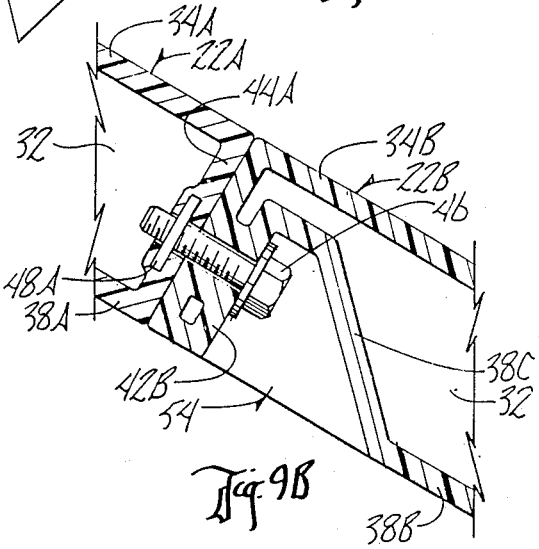
FIG. 9B is a view similar to FIG. 9A but showing an alternate fastener connection wherein the fastener is partially exposed on the bottom side of the bedway section.
Figure 9C:
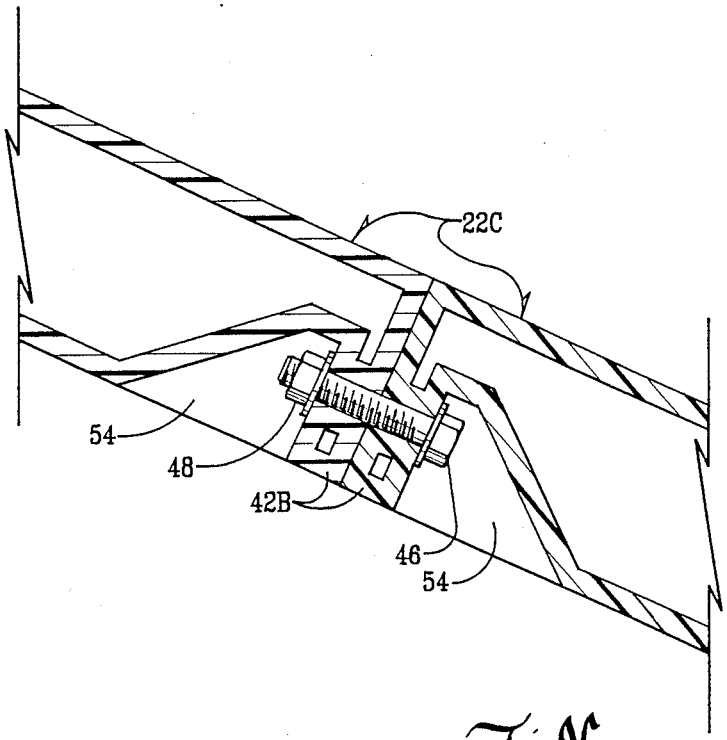
FIG. 9C is a view similar to FIG. 9A but showing the fastener of FIG. 9B.

In FIG. 9B, an alternate fastener arrangement is shown. In this arrangement, a nut fastener 48A is formed as an integral part of the end wall 44A of the half-turn bedway section 22A. No access opening through the bottom wall 38A is required in bedway section 22A. The bedway section 22B has a bottom wall 38B which includes a portion 38C which extends upwardly toward the top wall 34B and merges with the top wall 34B to form a downwardly extending end wall mounting flange 42B. This construction forms a fastener recess 54 between the mounting flange 42B and the bottom wall portion 38C. The fastener 46 is substantially hidden and out of reach in this recess 54. Since there are four fasteners interconnecting end-to-end bedway sections, there would be four recesses around the bottom periphery of a given bedway section utilizing this fastening arrangement. In FIG. 9C, fasteners 46 and 48 interconnect abutting end walls 42B and are substantially hidden and out of reach in recesses 54 in end-to-end bedway sections 22C.

The connection of the entry top one-quarter section 20 to a platform 56 are seen in FIGS. 2, 3A, 3B, 7 and 8. The exit bedway 20 has a fastener 48A molded into the end wall 44A and is engaged by bolt 46 extending through a downwardly extending flange 60 on the platform 56. Thus, it is seen that the fastener is totally concealed in the bedway section 20 and is partially hidden under the platform 56 but is accessible from the bottom side.

Figure 6B:
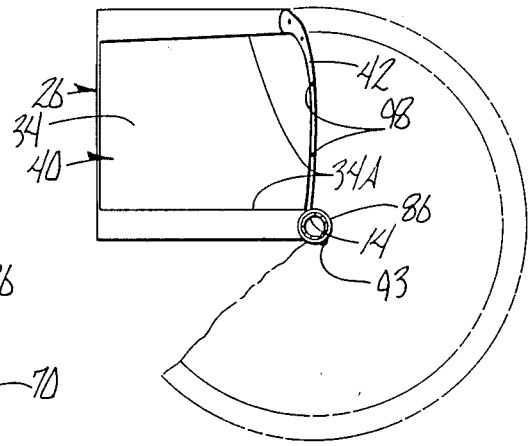

The bottom exit bedway 26, as seen in FIGS. 6A, 6B and 11, is connected to ground-support posts 62 having cross members 64. Bolts 66 extend through the cross members 64 and engage fastener nut 66 integrally formed in the bottom wall 38. It is thus seen that the fastener then is only exposed on the bottom side of the cross member 64 and is totally concealed within the interior 32 of the exit bottom bedway section 26. The nut 66 includes outwardly extending fins 68 which anchor the nut in the polyethylene material used for molding the bedway section 26 and bottom wall 38.

The posts 62 extend into a top layer of soft material such as bark 70 covering soil or the like 72. Concrete 74 is provided for anchoring the posts 62.

A very important feature of the slide bedway construction is that the bedway sections each include as an integral part of one sidewall a sleeve 80, as seen in FIG. 3A, for the entry top section 20. A sleeve 82 is provided on the half-turn bedway section 22 and a sleeve 84 is seen as an integral part of the one-quarter turn bedway section 24, while the exit bottom bedway section 26 includes a sleeve 86. The interior of each of these sleeves is common to the interior 32 of the bedway section itself since the sleeve is a part of the sidewall 36 to which it is attached. The entry top section 20 also includes, as an integral part of the sleeve 80, an integral mounting block 90 for connecting the platform 56 and associated railings 92 to the post 14. The sleeves on each of the bedway sections are stacked one on top of the other and substantially totally enclose the pole 14. A round-head screw 93 extends through each of the sleeves, as seen in FIG. 1, and is tapped into the metal post 14 and is positioned at a point on the sleeve most remote to the bedway such that it cannot be easily reached by persons using the slide.

Since four fasteners are used to interconnect each of the end-to-end bedway sections, holes 98 are provided in each of the end walls, as seen in FIG. 3A.

Thus, it is seen that an extremely safe and simple-inconstruction, maintenance-free spiral slide has been provided which is capable of being constructed in any number of different designs.

I claim:

1. A playground slide comprising, a plurality of interconnected bedway sections, a ground-supported post, and each of said sections including an integral sleeve portion telescopically engaging said post, each of said bedway sections having a hollow interior construction, including top, bottom, opposite side and end walls, said interconnected hollow bedway sections including said end walls on contiguous sections being opposed and interconnected by adjustable fasteners which extend into the interior of said hollow bedway sections, said bedway sections having the interconnected opposed end walls having access openings in one of the adjacent walls of at least one of the bed sections to provide access into the interior of the hollow bedway sections for adjustment of the fasteners, and a cap is provided on each of said access openings to give a finished smooth appearance to said one wall and conceal said fasteners within said hollow section.

2. A playground slide comprising, a plurality of interconnected bedway sections, a ground-supported post, and each of said sections including an integral sleeve portion telescopically engaging said post, each of said bedway sections having a hollow interior construction, including top, bottom, opposite side and end walls, said interconnected hollow bedway sections including said end walls on contiguous sections being opposed and interconnected by adjustable fasteners which extend into the interior of said hollow bedway sections, and said bedway sections having the interconnected opposed end walls having access openings in one of the adjacent walls of at least one of the bed sections to provide access into the interior of the hollow bedway sections for adjustment of the fasteners.

3. A playground slide comprising, a plurality of interconnected bedway sections, each of said bedway sections having a hollow interior construction, including top, bottom, opposite side and end walls, said interconnected hollow bedway sections including said end walls on contiguous sections being opposed and interconnected by adjustable fasteners which extend into the interior of said hollow bedway sections, said bedway sections having the interconnected opposed end walls having access openings in one of the adjacent walls of at least one of the bed sections to provide access into the interior of the hollow bedway sections for adjustment of the fasteners.

4. A playground slide comprising, a plurality of interconnected bedway sections, each of said bedway sections having a hollow interior construction, including top, bottom, opposite side and end walls, said interconnected hollow bedway sections including said end walls on contiguous sections being opposed and interconnected by adjustable fasteners, one of said fasteners extending from the interior of one said section to the interior of the other section through the end wall of one of said sections and into another of said fasteners on the end wall of the other of said sections, and said bedway sections having the interconnected opposed end walls having access openings in one of the adjacent walls of at least said one of the bed sections to provide access into the interior of the hollow bedway sections for adjustment of the fasteners.

5. A playground slide comprising, a plurality of interconnected bedway sections, each of said sections having top, bottom and opposite side end walls providing each section with a hollow interior, said interconnected sections having contiguous end walls, a first fastener being mounted on one of said end walls and the other end wall being formed by a portion of the bottom wall extending upwardly towards the top wall with said other end wall extending downwardly therefrom and forming a recess in said bottom wall, and a second fastener accessible in said recess extending through said other end wall and engaging said first fastener to interconnect said bedway sections.

6. A playground slide comprising, a plurality of interconnected bedway sections, each of said sections having top, bottom and opposite side end walls providing each section with a hollow interior, said interconnected sections having contiguous end walls, and one of said sections having its bottom wall adjacent said contiguous end wall formed with a recess providing access to an opening in said contiguous end wall through which a fastener extends into engagement with the contiguous end wall of the adjacent bedway section for interconnecting said bedway sections.

7. A playground slide comprising, a plurality of interconnected bedway sections, each of said sections having top, bottom and opposite side end walls providing each section with a hollow interior, said interconnected sections having contiguous end walls, and each of the bottom walls adjacent the contiguous end walls having a recess providing access to openings in the contiguous end walls through which fasteners extend for interconnecting said bedway sections.

8. The structure of claim 7 wherein said recesses are formed by a portion of the bottom wall extending upwardly towards the top wall adjacent said end wall extending downwardly from said top wall.

* * * * *